US005695360A

United States Patent [19]

Seto et al.

[11] Patent Number: 5,695,360

[45] Date of Patent: Dec. 9, 1997

[54] ZERO INSERTION FORCE ELECTRICAL CONNECTOR FOR FLAT CABLE

[75] Inventors: Masashi Seto, Zama; Shinsuke Kunishi, Hadano, both of Japan

[73] Assignee: Molex Incorporated, Lisle, Ill.

[21] Appl. No.: 623,269

[22] Filed: Mar. 28, 1996

[30] Foreign Application Priority Data

May 18, 1995 [JP] Japan ..... 7-144099

[51] Int. Cl.[6] ..... H01R 9/07

[52] U.S. Cl. ..... 439/495; 439/260

[58] Field of Search ..... 439/495, 260, 439/77, 67, 492, 493, 499, 326, 329, 341

[56] References Cited

U.S. PATENT DOCUMENTS

| | | | |
|---|---|---|---|
| 4,447,137 | 5/1984 | Ayer | 339/59 M |
| 4,936,792 | 6/1990 | Onoue et al. | 439/329 |
| 4,944,690 | 7/1990 | Imai | 439/492 |
| 5,458,506 | 10/1995 | Yamaguchi et al. | 439/495 |
| 5,580,272 | 12/1996 | Yamaguchi et al. | 439/495 |

FOREIGN PATENT DOCUMENTS

| | | | |
|---|---|---|---|
| 0 618 643 A2 | 10/1994 | European Pat. Off. | H01R 9/07 |
| 0 619 624 A2 | 10/1994 | European Pat. Off. | H01R 9/07 |
| 3-163771 | 7/1991 | Japan | H01R 23/00 |
| 7-61883 | 5/1992 | Japan | H01R 23/68 |

*Primary Examiner*—Gary F. Paumen
*Assistant Examiner*—Tho D. Ta
*Attorney, Agent, or Firm*—Stephen Z. Weiss

[57] ABSTRACT

A zero insertion force electrical connector is provided for a flat cable. The connector includes a dielectric housing mounting a plurality of terminals. The housing has a front end with an opening for receiving an end of the flat cable in engagement with contact portions of the terminals. An actuator is pivotally mounted relative to the housing for floating movement between a first position allowing free insertion of the flat cable into the opening and a second position biasing the cable against the terminals. A cam surface on the actuator abuts a counter cam surface on the housing as the actuator rotates and translates about a moving pivot from its first position to its second position sandwiching the end of the flat cable between the contact portions of the terminals and the actuator.

7 Claims, 11 Drawing Sheets

ZERO INSERTION FORCE ELECTRICAL CONNECTOR FOR FLAT CABLE

FIELD OF THE INVENTION

This invention generally relates to the art of electrical connectors and, particularly, to an electrical connector for terminating a flat cable, such as a flat flexible cable, without requiring any insertion force.

BACKGROUND OF THE INVENTION

There are a wide variety of zero insertion force electrical connectors particularly adapted for terminating flat cables, such as flexible flat cables. These electrical connectors conventionally use actuators to push the flexible flat cables, flexible printed circuit boards or the like against resilient contacts or terminals which are mounted in the connector housings.

Heretofore, the actuators have been designed to be pushed in and pulled out of the connector housings. Such designs require the application of insertion forces to the flat cables. In addition, such designs have inevitably resulted in an increase in the overall size of the connectors.

Consequently, some zero insertion force electrical connectors for flat cables have been designed with actuators which are pivotable between first, open positions allowing free insertion of the cables into the connector housings, and second, closed positions for clamping the flat cables against the terminals. In some such connectors, lock means are provided to hold the actuators in locked condition relative to the connector housing.

The present invention is directed to a new and improved zero insertion force electrical connector for flat cables of the character described above, wherein the actuator is pivotally mounted on the connector housing by means of a floating-pivot means and allows for increased linear or translational movement of the actuator in pushing the cable into the connector.

SUMMARY OF THE INVENTION

An object, therefore, of the invention is to provide a new and improved zero insertion force electrical connector for flat electrical cables, of the character described.

In the exemplary embodiment of the invention, the zero insertion force electrical connector includes a dielectric housing mounting a plurality of terminals in a generally parallel array. The housing has opposite sides and a front end with an opening between the sides for receiving an end of the flat cable in engagement with contact portions of the terminals. An actuator in the form of a pressure plate is pivotally mounted relative to the housing for floating movement between a first position allowing free insertion of the flat cable into the opening, and a second position biasing the cable against the terminals. The actuator or pressure plate has an extension on its rearward end for movement beneath an overhanging shelf means on the housing. A forwardly facing cam surface is provided on the pressure plate for abutting a rearwardly facing cam surface on the housing as the pressure plate is rotated about a moving pivot from its first position to its second position causing the extension of the pressure plate to advance beneath the overhanging shelf means on the housing, thereby sandwiching the end of the flat cable between the contact portions of the terminals and the pressure plate.

As disclosed herein, each of the terminals is bifurcated to define a contact branch and a support branch between which the flat cable is insertable. The support branches of the parallel array of terminals form the overhanging shelf means on the housing. The cam surfaces have cam profiles to allow substantial pivoting movement of the pressure plate relative to the housing followed by substantial translational movement of the pressure plate relative to the housing.

Other objects, features and advantages of the invention will be apparent from the following detailed description taken in connection with the accompanying drawings.

BRIEF DESCRIPTION OF THE DRAWING

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
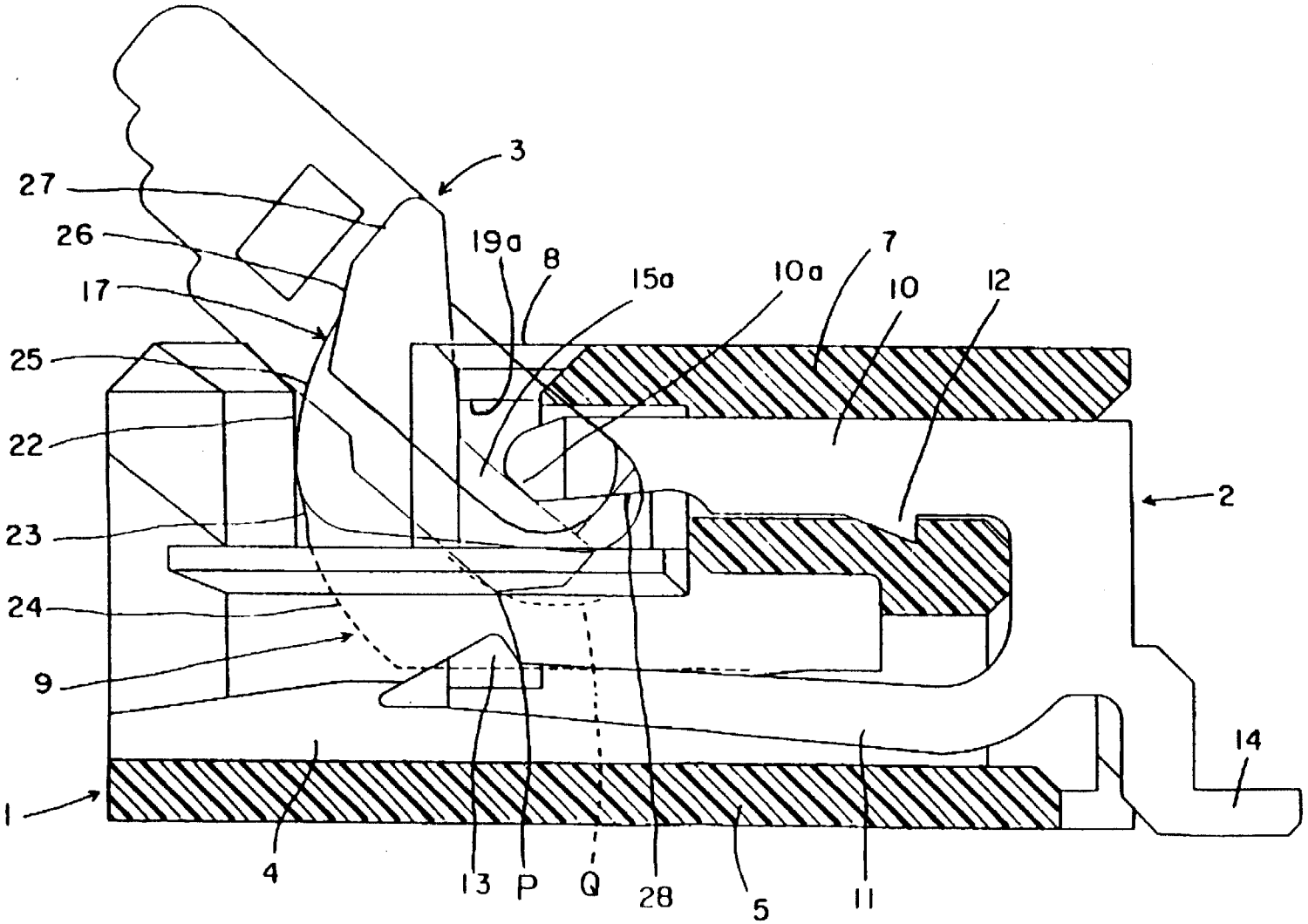
FIG. 1 is a vertical front-to-rear section through an electrical connector according to the invention.
Figure 2:
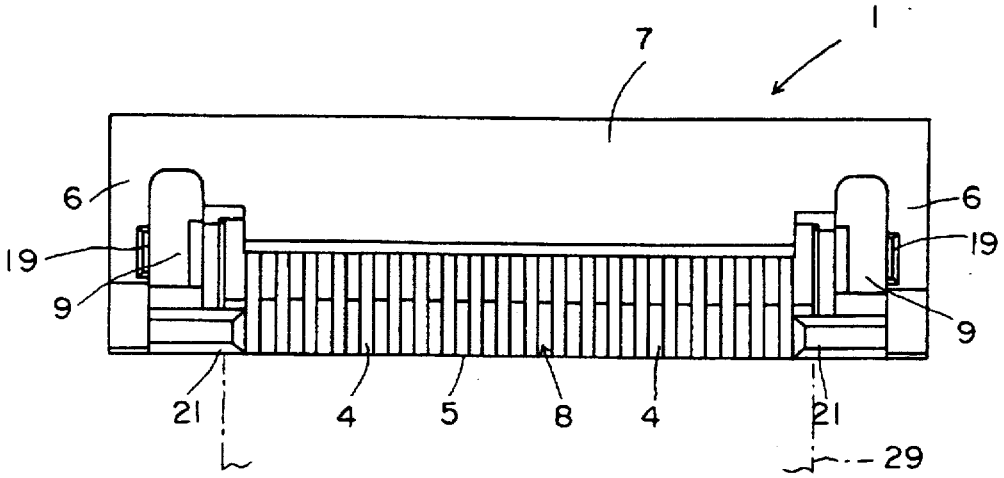
FIG. 2 is a top plan view of the housing for the connector.
Figure 3:
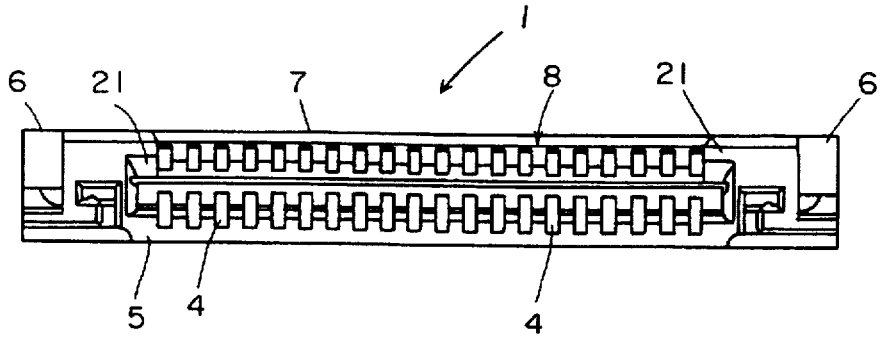
FIG. 3 is a front elevational view of the housing.
Figure 4:
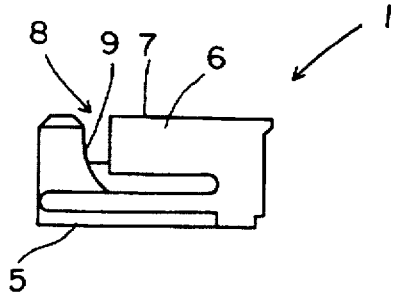
FIG. 4 is a side elevational view of the housing.

Referring to the drawings in greater detail, FIG. 1 shows an electrical connector for flat electrical cables according to the present invention. The connector includes a housing, generally designated 1, mounting a plurality of terminals, generally designated 2, and an actuator or pressure plate, generally designated 3. FIGS. 2–4 show further details of housing 1, and FIGS. 5–10 show details of the actuator or pressure plate 3.

Housing 1 is unitarily molded of dielectric material such as plastic or the like. The housing includes a bottom plate 5 having a plurality of slots 4 to accommodate terminals 2. The housing further includes opposite side walls 6 and a ceiling or top wall 7 which covers the top and approximately the rear one-half of the interior of the housing. Top wall 7 leaves an opening 8 in the front one-half of the housing and the front face of the housing for receiving the flat cable. As seen in FIGS. 1 and 4, each side wall 6 has a counter cam surface 9 facing in a rearward direction generally toward top wall 7. The counter cam surface cooperates with a cam surface on pressure plate 3 for guiding the pressure plate during its rotational and translational movements, as described hereinafter.

As seen best in FIG. 1, each terminal 2 is stamped and formed of sheet metal material and in a generally bifurcated configuration to define a relatively long, lower contact branch 11 and a relatively short, upper support branch 10. The upper support branch includes a triangular barb 12 that bites into the plastic material of the housing to establish an interference fit therewith and, thereby, fix the terminal in the housing. Lower contact branch 11 of each terminal 2 is vertically flexible and includes an upwardly projecting contact portion 13 at its forward distal end and an L-shaped tail 14 at its rear end. Tail 14 is adapted for soldering to a circuit trace on a printed circuit board (not shown), and the bottom of tail 14 is flush with the lower surface of the wall 5 of the housing. The terminals are mounted in a generally parallel array transversely or side-to-side of the housing.

Figure 5:
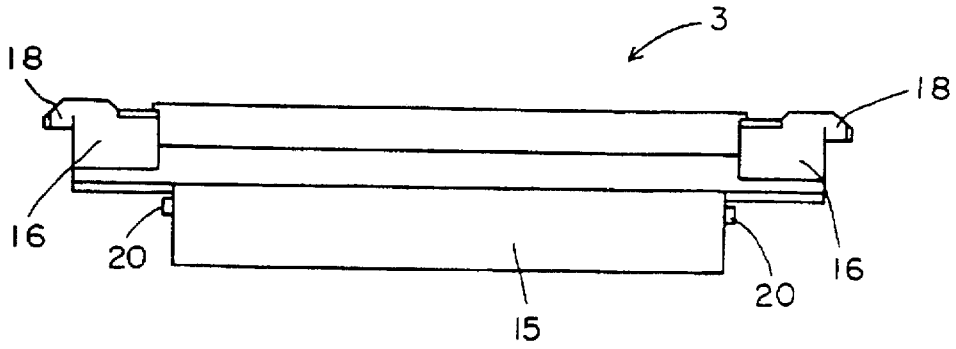
FIG. 5 is a top plan view of the actuator or pressure plate of the connector.
Figure 6:
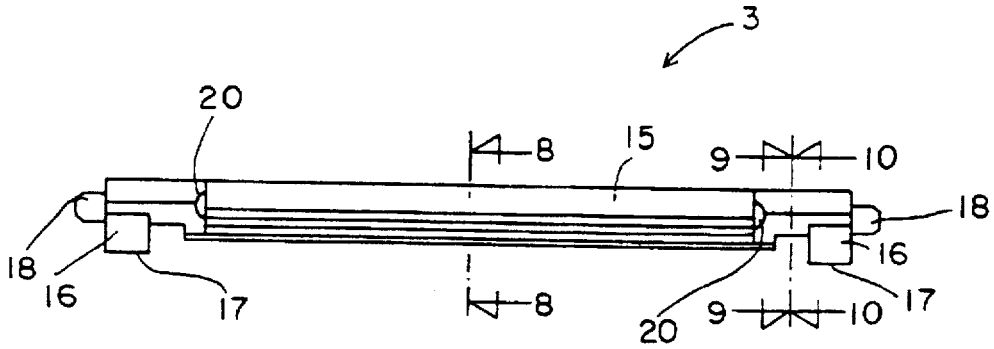
FIG. 6 is a front elevational view of the pressure plate.
Figure 7:
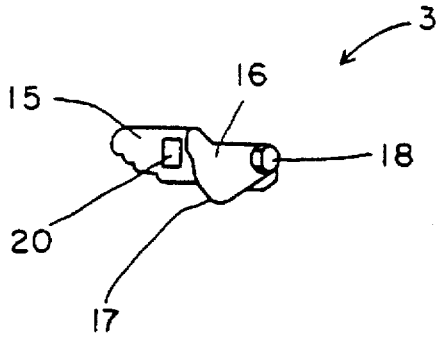
FIG. 7 is a side elevational view of the pressure plate.
Figure 8:
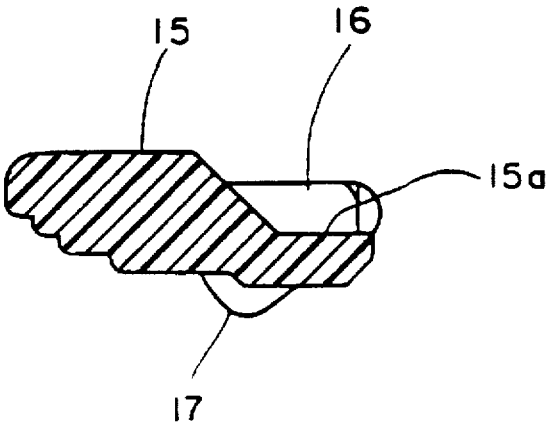
FIG. 8 is an enlarged section taken generally alone line 8—8 in FIG. 6.
Figure 9:
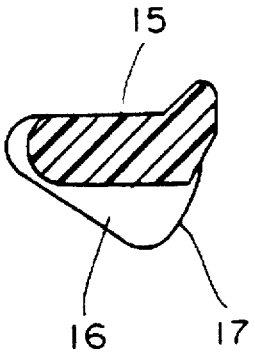
FIG. 9 is an enlarged section taken generally along line 9—9 in FIG. 6.
Figure 10:
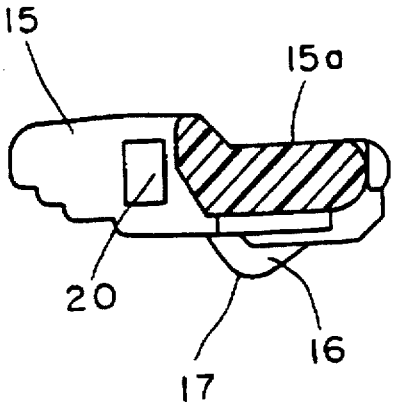
FIG. 10 is an enlarged section taken generally along line 10—10 in FIG. 6.

Referring to FIGS. 5–7, the actuator or pressure plate 3 is unitarily molded of dielectric material such as plastic or the like. The pressure plate includes a major transverse flat plate 15 large enough to cover the opening or space 8 at the top front of housing 1. A pair of flanges 16 are integrally formed with opposite sides of the transverse flat plate 15. Each flange 16 is generally triangular and has a forwardly facing cam surface 17. Cam surfaces 17 on opposite flanges 16 of pressure plate 3 confront counter cam surfaces 9 on housing 1.

Each flange 16 of pressure plate 3 has a laterally outwardly extending projection 18 on its outer surface. Each lateral projection 18 is movably fitted in an L-shaped slot 19 (FIG. 2) on the inner surface 19*a* of a respective one of the side walls 6 of housing 1. In addition, the transverse flat plate 15 of the pressure plate has lateral projections 20 at its opposite sides and which extend beneath inwardly-projecting lateral extensions 21 (FIG. 3) inside opposite side walls 6 of housing 1.

As seen best in FIG. 1, counter cam surface 9 on housing 1 includes a vertically linear cam section 22, a slanted cam section 23 and a curved cam section 24 consecutively or seriatim from the top to the bottom of cam surface 9. Cam surface 17 on pressure plate 3 includes a curved cam section 25, an angled cam section 26 and a vertically linear cam section 27 as viewed from bottom to top of cam surface 17.

Figure 11:
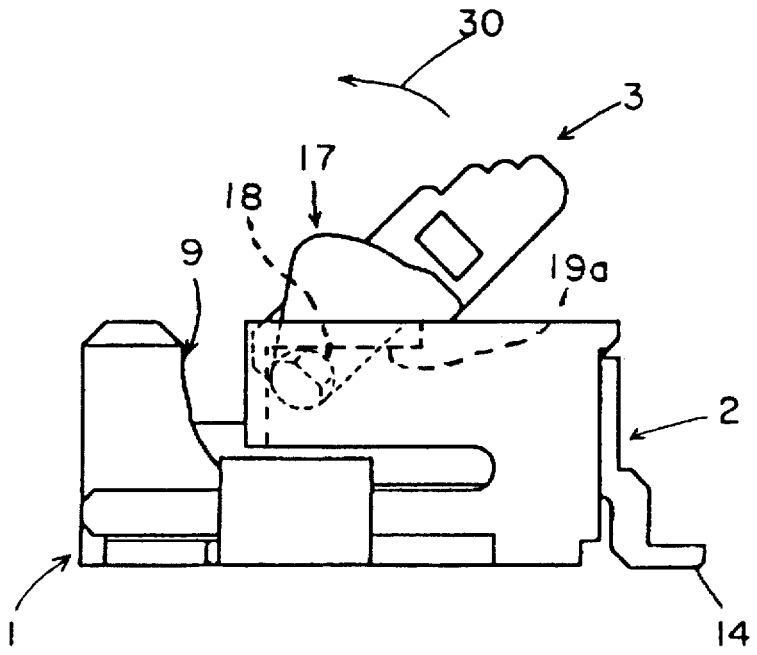
FIG. 11 is a side elevational view of the connector, with the pressure plate in its open position.
Figure 12:
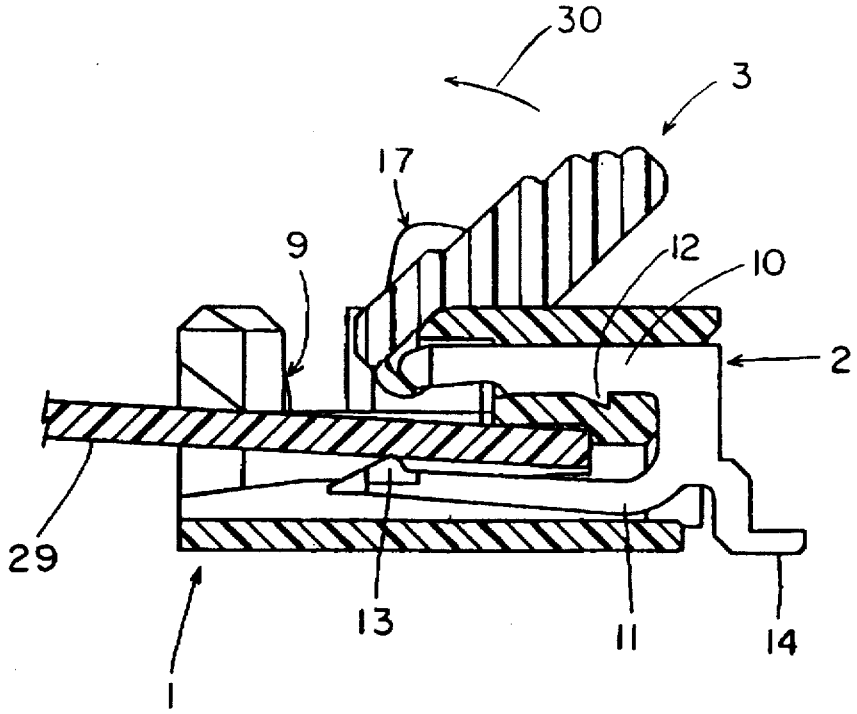
FIG. 12 is a vertical section through the connector, with the pressure plate in its open position and with a flat cable inserted into the connector.
Figure 13:
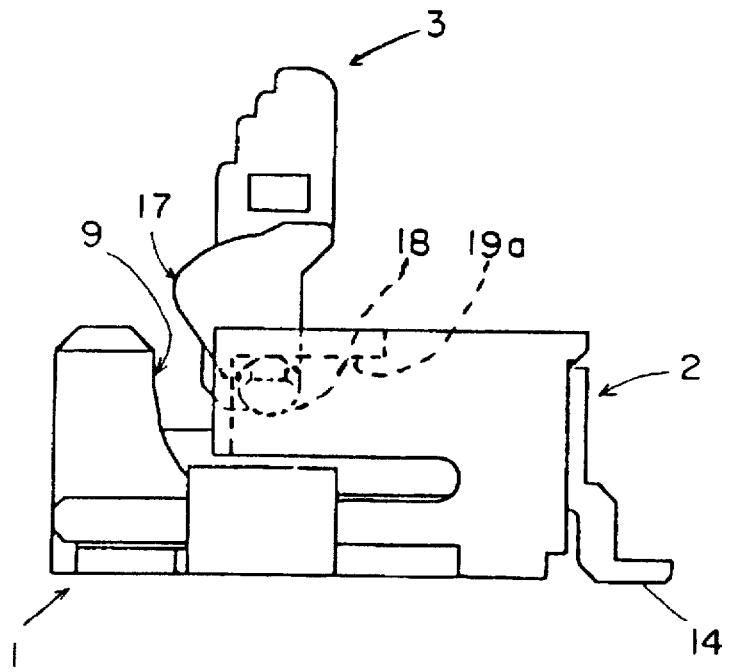
FIG. 13 is a side elevational view of the connector, with the pressure plate beginning to be rotated toward its closed position.
Figure 14:
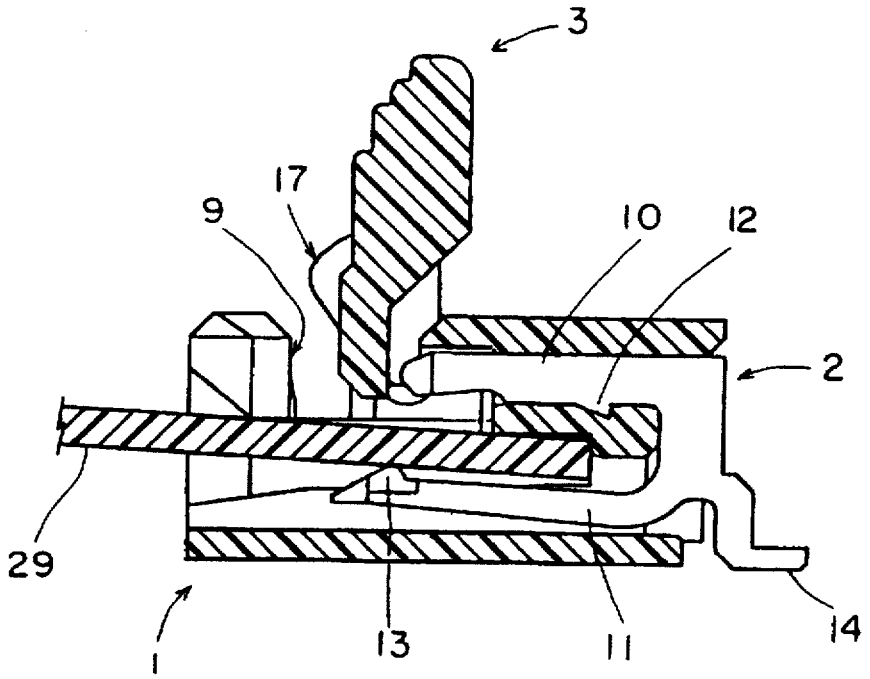
FIG. 14 is a vertical section through the connector in the condition of FIG. 13.
Figure 15:
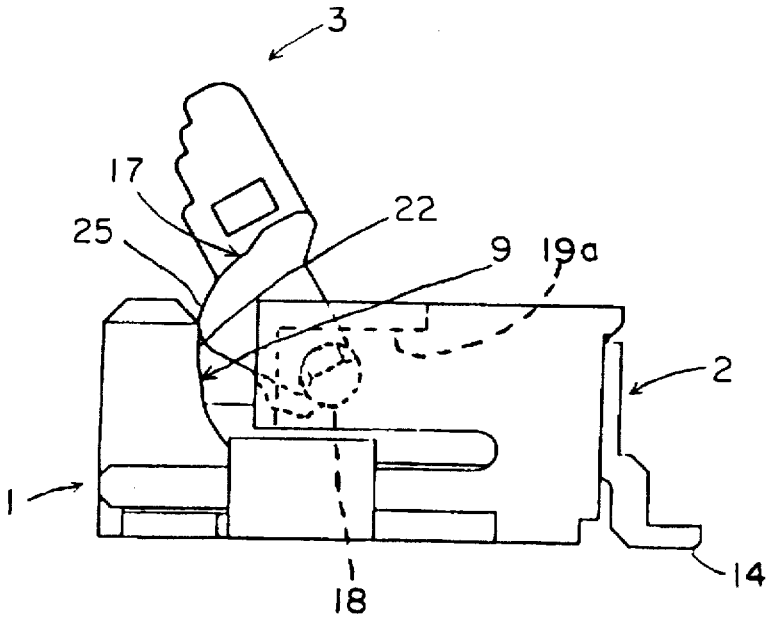
FIG. 15 is a side elevational view of the connector, with the cam surfaces just beginning to engage.
Figure 16:
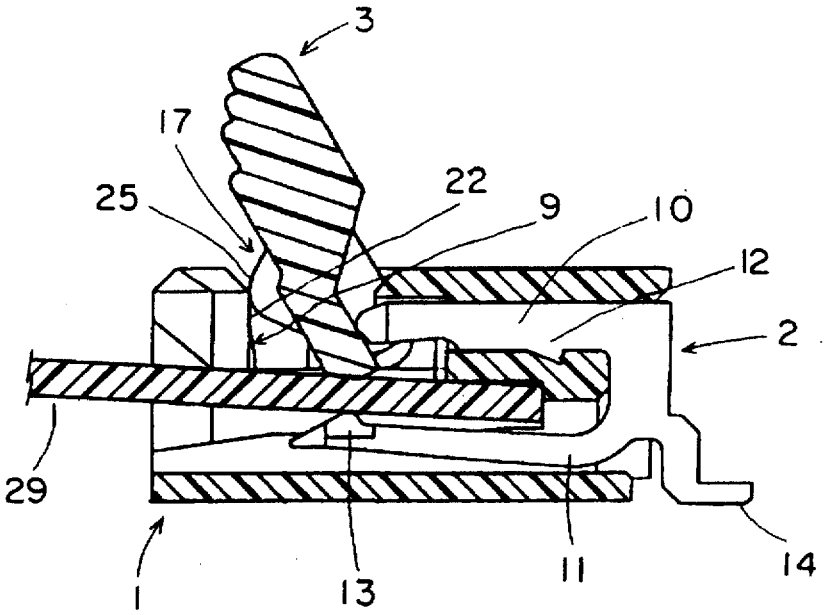
FIG. 16 is a vertical section through the connector in the condition of FIG. 15.
Figure 21:
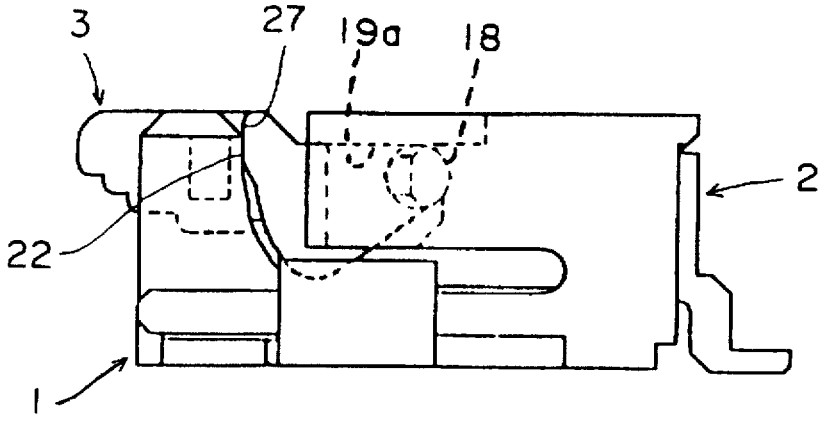
FIG. 21 is a side elevational view of the connector with the pressure plate in its final closed position.
Figure 22:
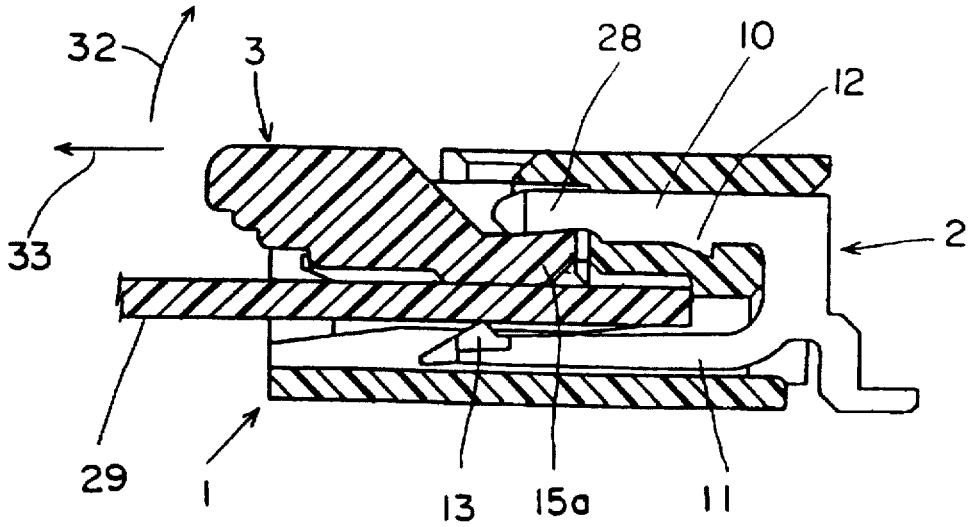
FIG. 22 is a vertical section through the connector in the condition of FIG. 21.

As pressure plate 3 is rotated from its open position shown in FIGS. 11 and 12 toward its closed position shown in FIGS. 21 and 22, a forward extension 15*a* of transverse flat plate 15 of pressure plate 3 advances into housing 1 such that the upper surface of forward extension 15*a* engages and moves under a comb-like lower bearing surface or shelf 28 defined by the underside of support branches 10 of the generally parallel array of terminals 2.

FIGS. 11 and subsequent drawings show the manner in which pressure plate 3 moves in a floating action (i.e. like a floating pivot) with respect to housing 1. Referring to FIGS. 11 and 12, pressure plate 3 is shown in its fully opened position in which a flat flexible cable 29 can be inserted into the housing. It should be noted that the flat cable is inserted into the housing without requiring any insertion force. It can be seen in FIG. 12 that the flat cable rests on top of contact portions 13 of flexible contact branches 11 of terminals 2. Thereafter, pressure plate 3 is rotated in the direction of arrows 30 until cam surfaces 17 on the pressure plate begins to abut the counter cam surfaces 9 on the housing, as shown in FIGS. 13, 14, 15 and 16.

Figure 17:
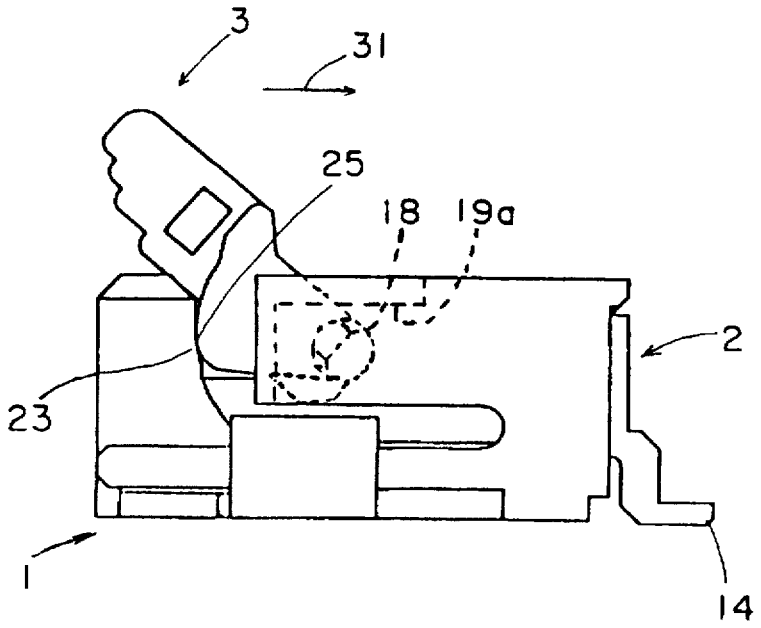
FIG. 17 is a side elevational view of the connector, with the pressure plate beginning to move linearly or translationally of the housing.
Figure 18:
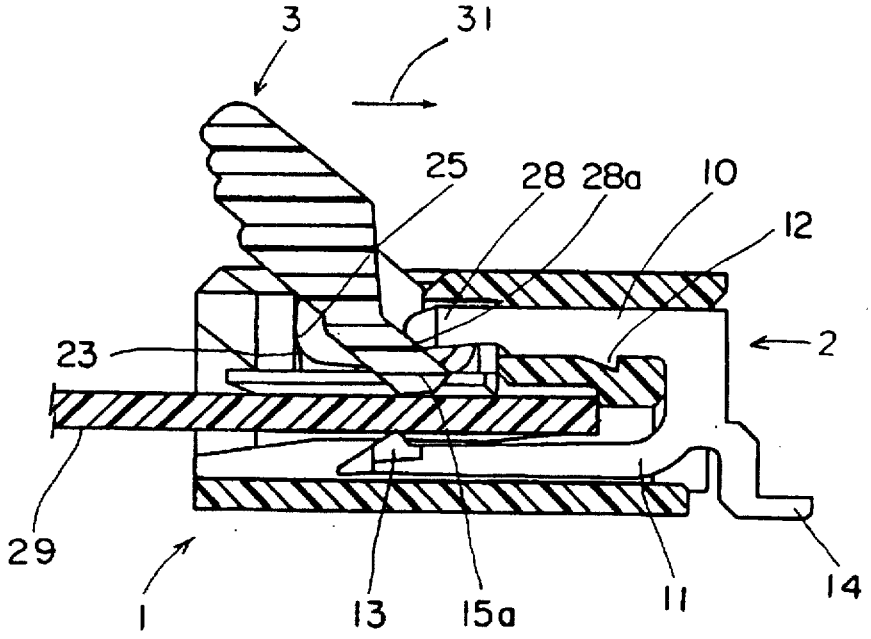
FIG. 18 is a vertical section through the connector in the condition of FIG. 17.
Figure 19:
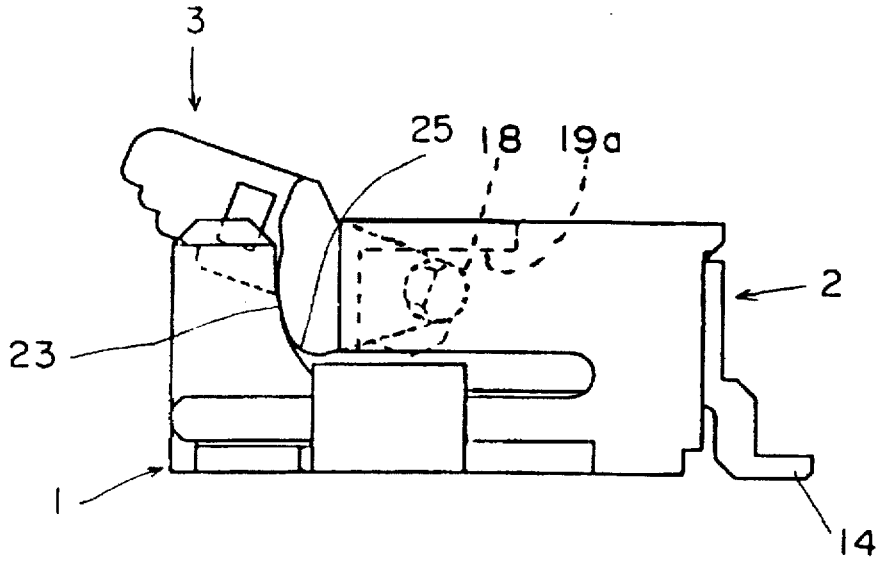
FIG. 19 is a side elevational view of the connector, with the pressure plate near its final position.
Figure 20:
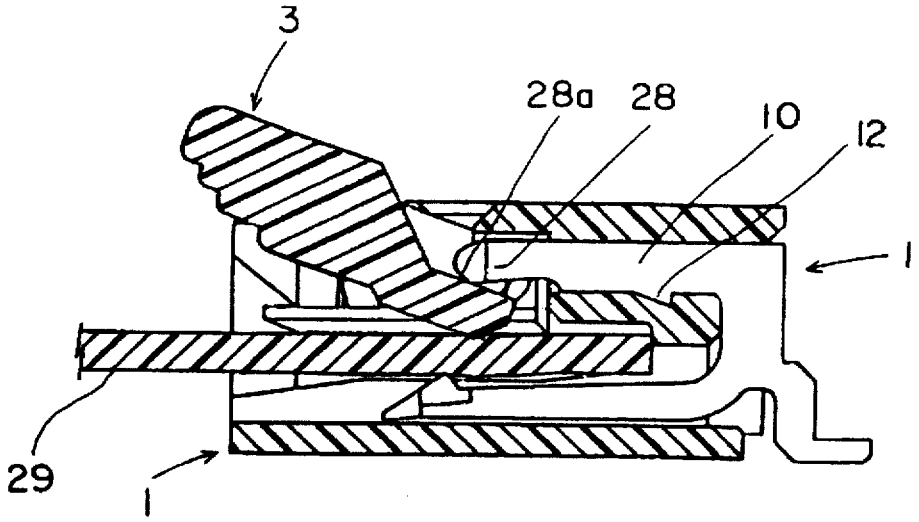
FIG. 20 is a vertical section through the connector in the condition of FIG. 19.

As seen in FIGS. 17 and 18, curved cam section 25 of cam surface 17 on pressure plate 3 abuts slanted cam section 23 of counter cam surface 9 on housing 1. At this point, pressure plate 3 begins to be pushed forward as a counter action relative to the housing in the direction of arrows 31. This causes forward extension 15*a* of transverse plate 15 to advance under the lower bearing surface or shelf means 28 defined by support branches 10 of terminals 2. The distal ends of support branches 10 have angled, straight surfaces 10*a* (FIG. 1) which confront the top flat surface of forward extension 15*a*, and this engagement, along with the counter action between the cam surfaces of the housing and the pressure plate, expedite the forward advancing of forward extension 15*a* of the transverse plate 15 into the housing as seen in FIGS. 1, 19 and 20. During this pivoting and translational movement of pressure plate 3 relative to housing 1, a pressure point "P" on the underside of forward extension 15*a* near the end of transverse plate 15 pushes flat cable 29 against contacts 13 of the underlying contact branches 11 of terminals 2. Pressure point "P" moves downwardly and forwardly as indicated by broken line "Q" in FIG. 1.

FIGS. 21 and 22 show the final position of actuator or pressure plate 3 relative to housing 1. In the final position, vertically linear cam section 27 of cam surface 17 of pressure plate 3 abuts vertically linear cam section 22 of cam surface 9 on housing 1, while forward extension 15*a* of the transverse plate 15 of pressure plate 3 is positioned fully under the shelf means formed by support branches 10 of terminals 2. In this position, flat cable 29 is sandwiched between the lower surface of forward extension 15*a* and contact portions 13 of contact branches 11 of terminals 2, with each exposed conductor on the underside of the flat cable contacting a contact portion 13 of a respective one of the terminals.

Figure 23:
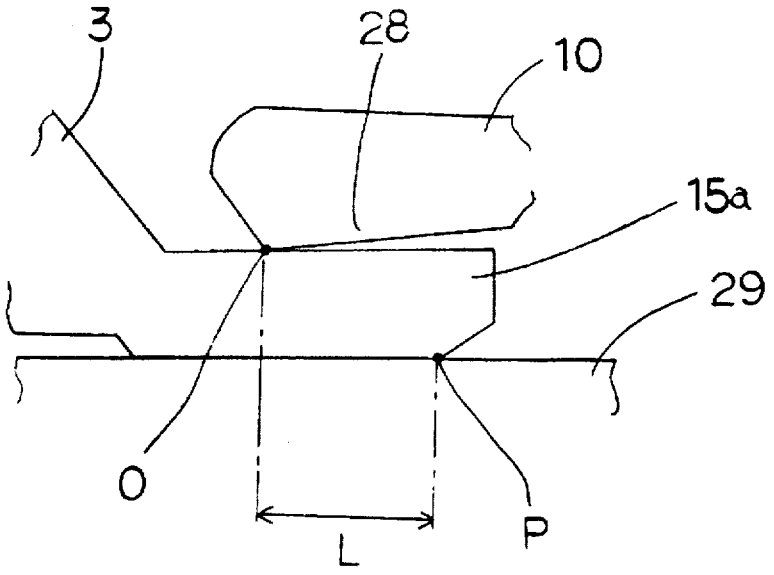
FIG. 23 is a fragmented, somewhat schematic view of various contact points on the pressure plate in its final closed position.

FIG. 23 is a schematic illustration to show a horizontal distance "L" between a final center of rotation "O" of pressure plate 3 and the point of pressure "P" in the final position of the pressure plate.

As can be understood from the above, pressure plate 3 is pushed forwardly while being rotated in a floating pivoting manner, as a counter action to housing 1 caused by the cooperation between cam surface 17 on the pressure plate and counter cam surface 9 on the housing. This provides an increased horizontal distance "L" (FIG. 23) from the final center of rotation to the pressure point, compared to prior art actuators that rotate about a fixed pivot. In addition, increased resistance is provided against the flat cable from slipping out of the connector when subjected to undesirable pulling forces which might tend to rotate pressure plate 3 toward its open position. In other words, it can be understood that pressure point "P" moves from the left-hand side of center of rotation "O" to the right-hand side as viewed in FIG. 23 to form a type of toggle arrangement as the pressure plate rotates and translates toward its final position. Therefore, no latching mechanism is necessitated because pulling on the cable only tightens its clamped engagement.

As seen in FIG. 2, inward lateral extensions 21 of the side walls of housing 1 overhang the opposite longitudinal edges of flat cable 29. These overhanging extensions tend to absorb at least a part of any undesirable pulling force applied to the flat cable, thereby reducing transmission of the pulling force to pressure plate 3 in the opening direction of the pressure plate.

In order to remove flat cable 29 from the electrical connector, pressure plate 3 is rotated in the direction of arrow 32 (FIG. 22) to cause a pulling force on the pressure plate then can be rotated about its floating or moving pivot back to its fully open position as shown in FIGS. 11 and 12 to permit easy removal of the flat cable.

Lastly, housing 1 may be designed to have a horizontal extension on the inside thereof to provide a shelf means or bearing surface 28 rather than providing the bearing surface by means of support branches 10 of terminals 3. In addition, L-shaped tails 14 of terminals 2 may be replaced by pin-like tails which can be inserted into holes in a printed circuit board.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A zero insertion force electrical connector for a flat cable, comprising:

a dielectric housing mounting a plurality of terminals in a generally parallel array, the housing having opposite sides and a front end with an opening between the sides for receiving an end of the flat cable in engagement with contact portions of the terminals;

a pressure plate pivotally mounted relative to the housing for floating movement between a first position allowing free insertion of the flat cable into the opening and a second position biasing the cable against the terminals, the pressure plate having an extension on its rearward end for movement beneath an overhanging shelf means on the housing; and a forwardly facing cam surface on the pressure plate for abutting a rearwardly facing cam surface on the housing as the pressure plate is rotated about a moving pivot from its first position to its second position causing substantial translational movement of the pressure plate relative to the housing and causing the extension of the pressure plate to advance beneath the overhanging shelf means on the housing, sandwiching the end of the flat cable between the contact portions of the terminal and the pressure plate.

2. The zero insertion force electrical connector of claim 1 wherein each of said terminals is bifurcated to define a contact branch and a support branch, the support branches of the parallel array of terminals forming said overhanging shelf means on the housing.

3. The zero insertion force electrical connector of claim 1 wherein at least one of said cam surfaces has a cam profile to effect the rotational movement of the pressure plate about the moving pivot and the substantial translational movement of the pressure plate relative to the housing.

4. The zero insertion force electrical connector of claim 3 wherein at least one of said cam surfaces has a plurality of discrete cam sections to define said cam profile to effect said pivoting and translational movements.

5. A zero insertion force electrical connector for a flat cable, comprising:

a dielectric housing mounting a plurality of terminals, the housing having a front end with an opening for receiving an end of the flat cable in engagement with contact portions of the terminals;

an actuator pivotally mounted relative to the housing for floating movement between a first position allowing free insertion of the flat cable into the opening and a second position biasing the cable against the terminals; and a cam surface on the actuator for abutting a counter cam surface on the housing as the actuator is rotated about a moving pivot from its first position to its second position, causing the actuator to rotate and translate relative to the housing and sandwiching the end of the flat cable between the contact portions of the terminals and the actuator.

6. The zero insertion force electrical connector of claim 5 wherein at least one of said cam surfaces has a cam profile to effect the rotational movement of the actuator about the moving pivot and the translational movement of the actuator relative to the housing.

7. The zero insertion force electrical connector of claim 6 wherein at least one of said cam surfaces has a plurality of discrete cam sections to define said cam profile to effect said pivoting and translational movements.

* * * * *